US012704087B2

(12) United States Patent
Koo

(10) Patent No.: US 12,704,087 B2
(45) Date of Patent: Aug. 11, 2026

(54) METHOD AND SYSTEM FOR DIAGNOSING THERMOSTAT FAULT OF ENGINE COOLING SYSTEM

(71) Applicants: HYUNDAI MOTOR COMPANY, Seoul (KR); KIA CORPORATION, Seoul (KR)

(72) Inventor: Bon-Chang Koo, Hwaseong-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 18/907,773

(22) Filed: Oct. 7, 2024

(65) Prior Publication Data

US 2025/0369387 A1 Dec. 4, 2025

(30) Foreign Application Priority Data

May 30, 2024 (KR) ..... 10-2024-0070912

(51) Int. Cl.
*F02D 41/02* (2006.01)
*F01P 5/02* (2006.01)
(Continued)

(52) U.S. Cl.
CPC ..... *F01P 11/14* (2013.01); *F01P 5/02* (2013.01); *F01P 7/16* (2013.01); *F01P 2007/146* (2013.01); *F01P 2025/08* (2013.01)

(58) Field of Classification Search
CPC ..... F01P 11/16; F01P 7/16; F01P 2031/32; F01P 11/14; F01P 2060/18; F01P 5/02;
(Continued)

(56) References Cited

U.S. PATENT DOCUMENTS 9,869,233 B2 1/2018 Byun et al.
2007/0102206 A1* 5/2007 Lee ..... B60W 10/26 903/910
(Continued)

FOREIGN PATENT DOCUMENTS

CN 115139728 A * 10/2022 ..... B60H 1/00735
DE 69935923 T2 * 1/2008 ..... F01P 9/06
(Continued)

OTHER PUBLICATIONS

FR20210058167 A_English Translation_Description (Year: 2021).*

*Primary Examiner* — George C Jin
*Assistant Examiner* — Teuta B Holbrook
(74) *Attorney, Agent, or Firm* — Fish & Richardson P.C.

(57) ABSTRACT

A method diagnoses a thermostat of an engine cooling system, where the thermostat provided at a heater core installed at a rear end of an evaporator of a heating and cooling path and at an engine coolant path formed to circulate coolant through an engine. The method includes receiving, by a diagnostic module, an operating current of a blower motor configured to operate a blower which supplies outside air to the evaporator; calculating, by the diagnostic module, an accumulated blower operating amount for a certain period of time using the operating current of the blower motor; and comparing, by the diagnostic module, the accumulated blower operating amount with a set operating amount. The method can prevent misdiagnosis of the thermostat by monitoring the blower motor to diagnose whether a fault occurs in the thermostat.

13 Claims, 7 Drawing Sheets

(51) Int. Cl.
*F01P 7/16* (2006.01)
*F01P 11/14* (2006.01)
*F01P 7/14* (2006.01)

(58) Field of Classification Search
CPC ..... F01P 2025/00; F01P 2025/32; F01P 1/00; F01P 2005/046
See application file for complete search history.

(56) References Cited

U.S. PATENT DOCUMENTS

| | | | | |
|---|---|---|---|---|
| 2008/0238607 | A1* | 10/2008 | Schuricht | F01P 7/044 340/3.1 |
| 2023/0057741 | A1* | 2/2023 | Prabhakar | G06F 1/324 |

FOREIGN PATENT DOCUMENTS

| | | | | | |
|---|---|---|---|---|---|
| JP | H10299484 | A | * | 11/1998 | F01P 3/18 |
| KR | 20050098682 | A | * | 10/2005 | B44F 9/02 |
| KR | 20120060076 | A | * | 6/2012 | G01R 11/34 |
| KR | 10-1714176 | | | 3/2017 | |
| KR | 20210058167 | A | * | 5/2021 | G05D 23/02 |

* cited by examiner

METHOD AND SYSTEM FOR DIAGNOSING THERMOSTAT FAULT OF ENGINE COOLING SYSTEM

CROSS-REFERENCE(S) TO RELATED APPLICATIONS

This application claims priority to Korean Patent Application No. 10-2024-0070912, filed on May 30, 2024, which is incorporated herein by reference in its entirety.

TECHNICAL FIELD

The present disclosure relates to a method and a system for diagnosing a fault of a thermostat provided in an engine cooling system. In particular, the present disclosure relates to a method of diagnosing a fault of a thermostat, where the method may be an item added to an enhanced on-board diagnostics (OBD).

BACKGROUND

Engine cooling methods may include an air cooling method which uses air to cool an engine to prevent overheating and a water cooling method which circulates coolant inside the engine to cool the engine.

In some examples, a water-cooling type cooling system may cool an engine with coolant circulating through a coolant path of the engine, which is formed between the engine and a heater core of a heating, ventilation, and air conditioning (HVAC) system.

In some cases, a thermostat may be installed on an engine outlet side of the coolant path of the engine. After a starting, when a temperature of coolant of the engine rises and exceeds a target regulating temperature (e.g., 85 degrees), the thermostat becomes in an open state to allow the coolant to circulate toward a radiator. In this way, when the temperature of the coolant decreases, the thermostat becomes a closed state and operates to maintain an engine temperature at a warm-up temperature or more.

Referring to FIGS. 1 and 2, a fault diagnosis of the thermostat is performed when an actual temperature of the coolant does not reach the warm-up temperature, and when a model temperature (Model ECT) reaches a regulating temperature (target temperature) after the starting, and the model temperature is determined by considering an operating condition.

When a fault occurs in the thermostat and a valve is still opened even at a preset temperature or less, since the coolant continues to circulate and cool through the radiator, thermal efficiency of the engine is reduced and emission thereof is deteriorated so that fuel consumption is increased.

In the case of the existing logic, when a blower is used, the coolant temperature of the engine decreases due to heat exchange and remains at a set temperature or less in the same way as when an open fault occurs in the thermostat, which may lead to a misdiagnosis of a thermostat fault.

SUMMARY

The present disclosure describes a method and a system for diagnosing a fault of a thermostat of an engine cooling system, which can prevent thermostat misdiagnosis by monitoring a blower motor and diagnosing whether a fault occurs in the thermostat.

Other objects and advantages of the present disclosure can be understood by the following description and become apparent with reference to the implementations of the present disclosure. Also, it is obvious to those skilled in the art to which the present disclosure pertains that the objects and advantages of the present disclosure can be realized by the means as claimed and combinations thereof.

According to one aspect of the subject matter described in this application, a method diagnoses a fault of a thermostat of an engine cooling system, which diagnoses a heater core installed at a rear end of an evaporator of a heating and cooling path and a thermostat installed on an engine coolant path formed to allow coolant to circulate through the engine. The method includes receiving, by a diagnostic module, an operating current of a blower motor configured to operate a blower which supplies outside air to the evaporator; calculating, by the diagnostic module, an accumulated blower operating amount for a certain period of time using the operating current of the blower motor; and comparing, by the diagnostic module, the accumulated blower operating amount with a set operating amount, wherein, when the accumulated blower operating amount is less than the set operating amount, the thermostat is diagnosed as faulty, and when the accumulated blower operating amount is greater than or equal to the set operating amount, the thermostat is diagnosed as normal.

In some examples, the calculating of the accumulated blower operating amount may include calculating the accumulated blower operating amount by integrating the product of an operating current and an operating voltage of the blower motor for the certain period of time.

In some implementations, the method may further include, before the comparing of the accumulated blower operating amount with the set operating amount, receiving a coolant temperature of the coolant, and comparing the coolant temperature with a set temperature, wherein, when the coolant temperature is lower than or equal to the set temperature, the comparing of the accumulated blower operating amount with the set operating amount may be performed, and when the coolant temperature exceeds the set temperature, the thermostat may be diagnosed as normal.

In some examples, the set temperature may be a thermostat opening temperature.

In some implementations, the method may further include, when the coolant temperature is lower than or equal to the set temperature, determining whether a run time of the engine exceeds the certain period of time, and when the run time of the engine exceeds the certain period of time, the comparing of the accumulated blower operating amount with the set operating amount may be performed.

In some implementations, the method may further include, before the comparing of the coolant temperature with the set temperature, comparing a target revolutions per minute (RPM) of the blower motor with a first RPM, and when the target RPM is less than or equal to the first RPM, the comparing of the coolant temperature with the set temperature may be performed.

In some implementations, the method may further include, when the target RPM exceeds the first RPM, comparing a deviation between the target RPM and a current RPM of the blower motor with a second RPM, and when the deviation between the target RPM and the current RPM of the blower motor is less than or equal to the second RPM, the comparing of the coolant temperature with the set temperature may be performed.

In some implementations, when the deviation between the target RPM and the current RPM exceeds the second RPM for a certain period of time, the blower may be diagnosed as having a performance abnormality; and when the deviation between the target RPM and the current RPM of the blower motor does not exceed the second RPM for the certain period of time, the comparing of the coolant temperature with the set temperature may be performed.

According to another aspect, a system diagnoses a fault of a thermostat of an engine cooling system, which diagnoses a heater core installed at a rear end of an evaporator of a heating and cooling path and a thermostat installed on an engine coolant path formed to allow coolant to circulate through the engine. The system includes a blower motor module configured to operate a blower motor which operates a blower supplying outdoor air to the evaporator, a heater control module configured to control the blower motor module and receive an operating current of the blower motor from the blower motor module, and a diagnostic module configured to calculate an accumulated blower operating amount for a certain period of time using the operating current of the blower motor by receiving the operating current of the blower motor from the heater control module and compare the accumulated blower operating amount with a set operating amount, and when the accumulated blower operating amount is less than the set operating amount, the diagnostic module diagnoses the thermostat as faulty, and when the accumulated blower operating amount is greater than or equal to the set operating amount, the diagnostic module diagnoses the thermostat as normal.

Here, the accumulated blower operating amount may be calculated by integrating the product of an operating current and an operating voltage of the blower motor for the certain period of time.

In some implementations, the diagnostic module may receive a coolant temperature of the coolant, compare the coolant temperature with a set temperature, and when the coolant temperature exceeds the set temperature, the diagnostic module may diagnose the thermostat as normal; and when the coolant temperature is lower than or equal to the set temperature, the diagnostic module may compare the accumulated blower operating amount with a set operating amount.

In some examples, the set temperature may be a thermostat opening temperature.

In some implementations, when the coolant temperature is lower than or equal to the set temperature, the diagnostic module may determine whether a run time of the engine exceeds the certain period of time, and when the run time of the engine exceeds the certain period of time, the diagnostic module may compare the accumulated blower operating amount with the set operating amount.

In some implementations, the diagnostic module may compare a target revolutions per minute (RPM) of the blower motor with a first RPM, and when the target RPM is lower than or equal to the first RPM, the diagnostic module may diagnose whether a fault occurs in the thermostat; and when the target RPM exceeds the first RPM, the diagnostic module may diagnose the blower motor as having a performance abnormality.

In some implementations, when the target RPM exceeds the first RPM, the diagnostic module may compare a deviation between the target RPM and a current RPM of the blower motor with a second RPM, and when the deviation between the target RPM and the current RPM is less than or equal to the second RPM, the diagnostic module may diagnose whether a fault occurs in the thermostat; and when the deviation between the target RPM and the current RPM exceeds the second RPM for a certain period of time, the diagnostic module may diagnose the blower as having a performance abnormality.

In some implementations, the diagnostic module may correct a model coolant temperature setting value by reflecting the operating current and the operating voltage of the blower motor and may control the blower motor to operate according to the corrected model coolant temperature.

DETAILED DESCRIPTION

In order to fully understand the present disclosure and operational advantages of the present disclosure and objects attained by practicing the present disclosure, reference should be made to the accompanying drawings that illustrate exemplary implementations of the present disclosure and to the description in the accompanying drawings.

In describing exemplary implementations of the present disclosure, known technologies or repeated descriptions may be reduced or omitted to avoid unnecessarily obscuring the gist of the present disclosure.

Figure 1:
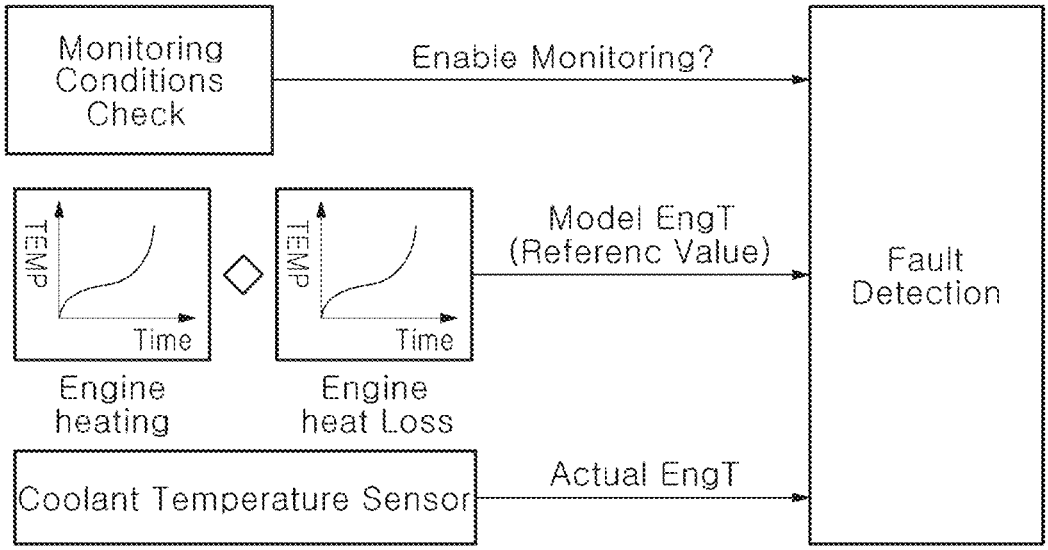
FIG. 1 (RELATED ART)
FIG. 1 is a schematic diagram illustrating an example of a logic of a method of diagnosing a thermostat fault.
Figure 2:
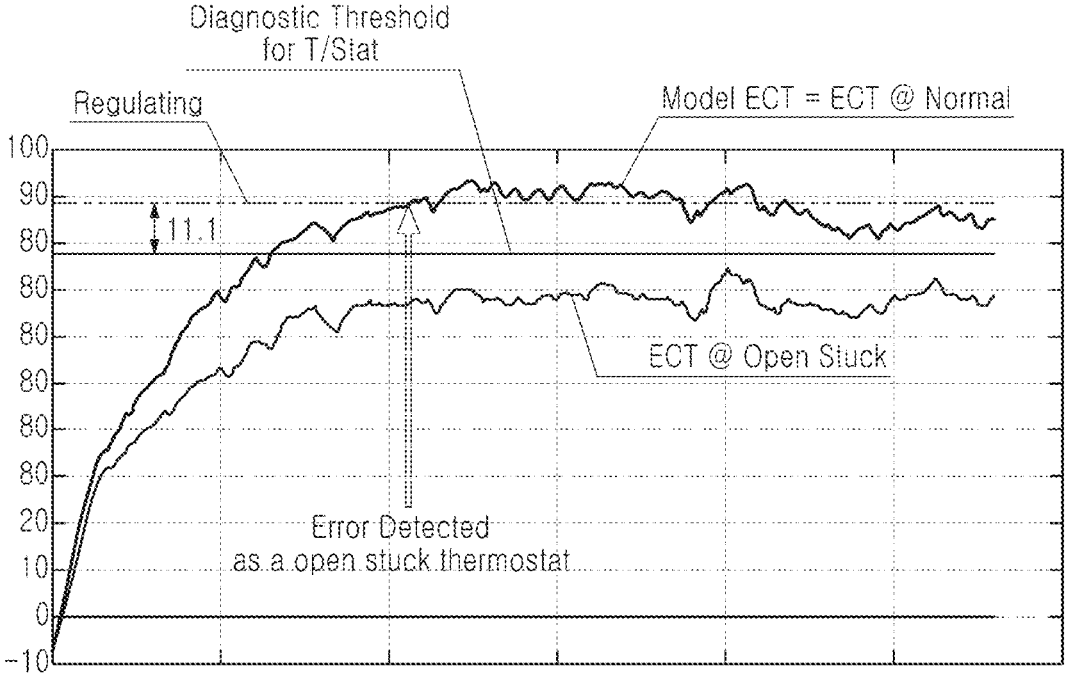
FIG. 2 (RELATED ART)
FIG. 2 is a diagram illustrating an example of a temperature for diagnosis.
Figure 3:
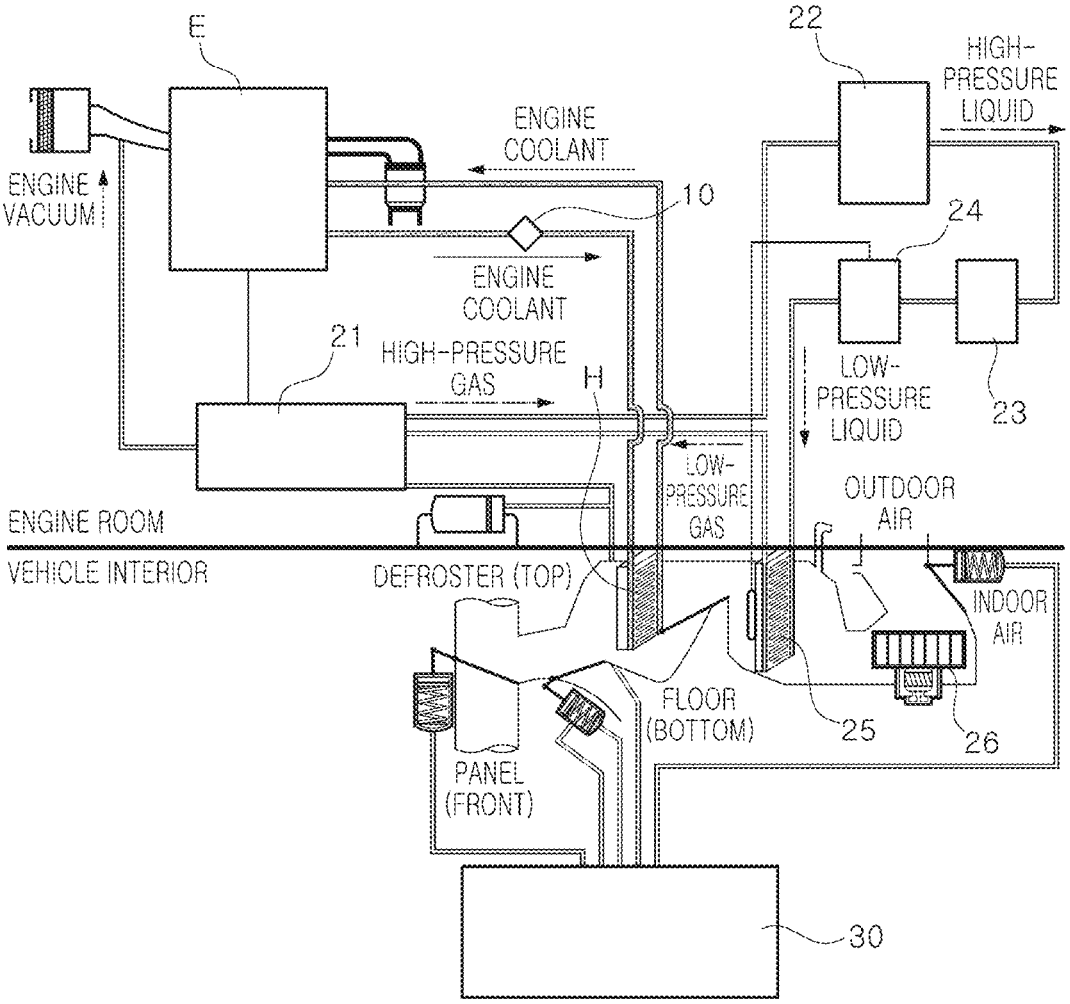
FIG. 3 is a schematic diagram illustrating an example of an engine cooling system and a heating, ventilation, and air conditioning (HVAC) system.
Figure 4:
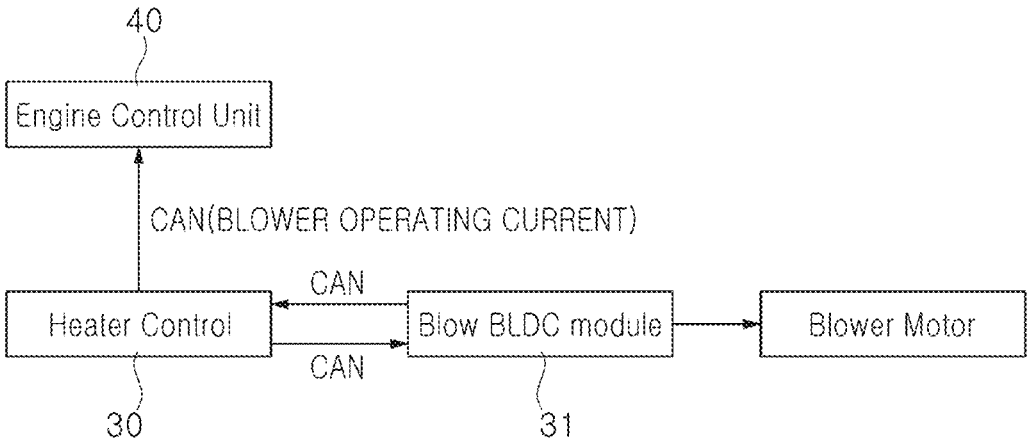
FIG. 4 is a diagram illustrating an example of a partial configuration of a system for diagnosing a thermostat fault of the engine cooling system of the present disclosure.

FIG. 3 is a schematic diagram illustrating an engine cooling system and a heating, ventilation, and air conditioning (HVAC) system, and FIG. 4 is a diagram illustrating a partial configuration of a system for diagnosing a thermostat fault of the engine cooling system of the present disclosure.

Hereinafter, the system for diagnosing a thermostat fault of the engine cooling system of the present disclosure will be described with reference to FIGS. 3 and 4.

In some cases, when a fault occurs in a thermostat and a valve is still opened even at a preset temperature or less, since coolant continues to circulate and cool through a radiator, thermal efficiency of an engine is reduced and emission thereof is deteriorated so that fuel consumption is increased.

In some cases, where a blower is used, a coolant temperature of the engine decreases due to heat exchange and remains at a set temperature or less in the same way as when an open fault occurs in the thermostat, which may lead to a misdiagnosis of the thermostat fault. For example, when the coolant temperature ranges from 70° C. to 74° C., a thermostat diagnosis is performed, but the thermostat diagnosis may not be possible because a difference from the coolant temperature is not large due to the blower.

The present disclosure relates to a system and a method for monitoring a blower signal of a heating, ventilation, and air conditioning (HVAC) system and diagnosing the HVAC system in order to prevent misdiagnosis of the thermostat of the engine cooling system.

For example, since a reduction amount of the coolant temperature of the engine is determined according to a rotation speed of a brushless direct current (BLDC) motor type blower, by receiving and considering blower operation information, and when an operation time becomes long and thus a set coolant temperature may not be reached, the fault diagnosis is controlled to be prohibited. In addition, when a performance abnormality occurs in a BLDC type motor, the thermostat diagnosis is stopped to prevent misdiagnosis.

As shown in FIG. 3, an engine coolant path of the engine cooling system is formed between an engine E and a heater core H of the HVAC system, and the engine is cooled by coolant circulating in the engine coolant path.

A thermostat 10 is installed on an engine outlet of the engine coolant path, and when the engine coolant temperature exceeds a target regulating temperature, the thermostat operates to be opened to circulate the coolant and exchange heat is performed in the heater core H, and when the coolant temperature decreases again, the thermostat operates to be closed to maintain an engine temperature at a warm-up temperature or more.

In the HVAC system, a high-pressure gas by a compressor 21 is condensed by a condenser 22 to change into a high-pressure liquid refrigerant state, moisture is removed by a receiver drier 23, and the high-pressure gas is expanded by an expansion valve 24 to become a low-temperature and low-pressure liquid state.

Thereafter, the low-pressure liquid is transformed into a gas by absorbing surrounding heat in the evaporator 25 installed on a heating and cooling path and then circulates back to the compressor 21.

In this case, a blower 26 is operated by the blower motor to supply outdoor air to the evaporator 25, and thus the air cooled by the evaporator 25 in the heating and cooling path cools the coolant by the heater core H and is heated.

A heater control module 30 of the HVAC system controls a temperature of an interior by controlling a functional configuration of the HVAC system and the opening and closing of each air outlet of the heating and cooling path according to a selection of a mode such as air conditioning, dehumidification, ventilation, and air intake, and a selection of a temperature and a direction.

That is, as shown in FIG. 4, the heater control module 30 controls an operation of the blower motor with a blower motor module 31 through communication (controller area network (CAN)), and an engine control unit (ECU) 40 as a diagnostic module receives an operating current of the blower motor from the heater control module and performs a fault diagnosis of the thermostat.

Figure 5:
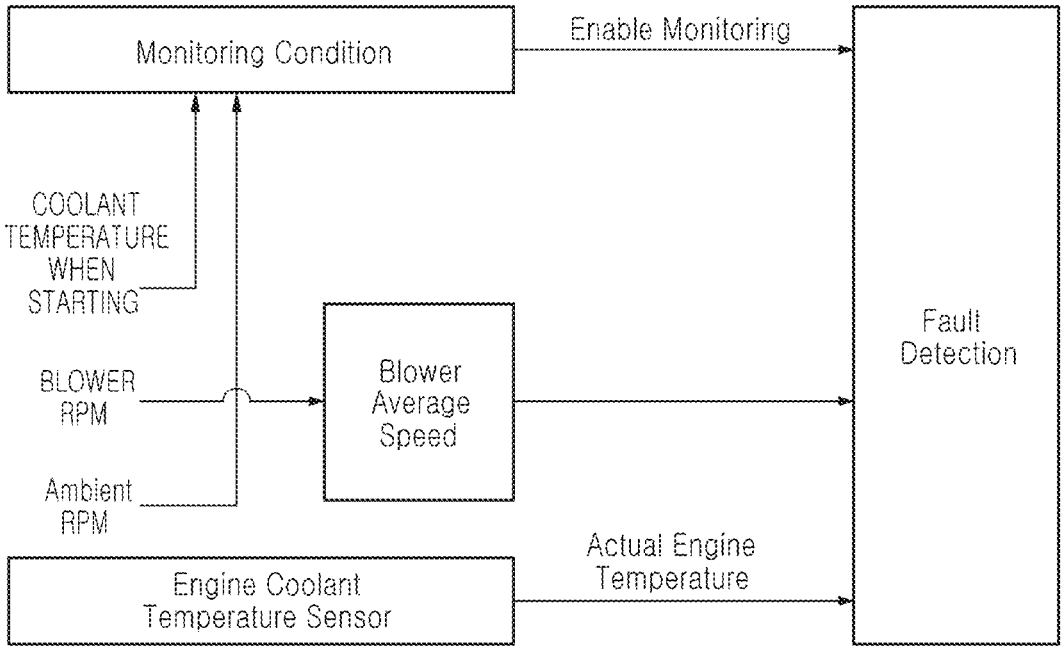
FIG. 5 is a schematic diagram illustrating an example of a logic of a method of diagnosing a thermostat fault according to the present disclosure.

FIG. 5 shows a logic of an example method of diagnosing a thermostat fault according to the present disclosure, and whether to perform diagnosis is determined according to monitoring conditions such as a coolant temperature and an ambient temperature when starting, and a thermostat fault is diagnosed (Fault Detection) using a revolutions per minute (RPM) and average speed of the blower and an actual engine temperature from an engine coolant temperature sensor.

Figure 6:
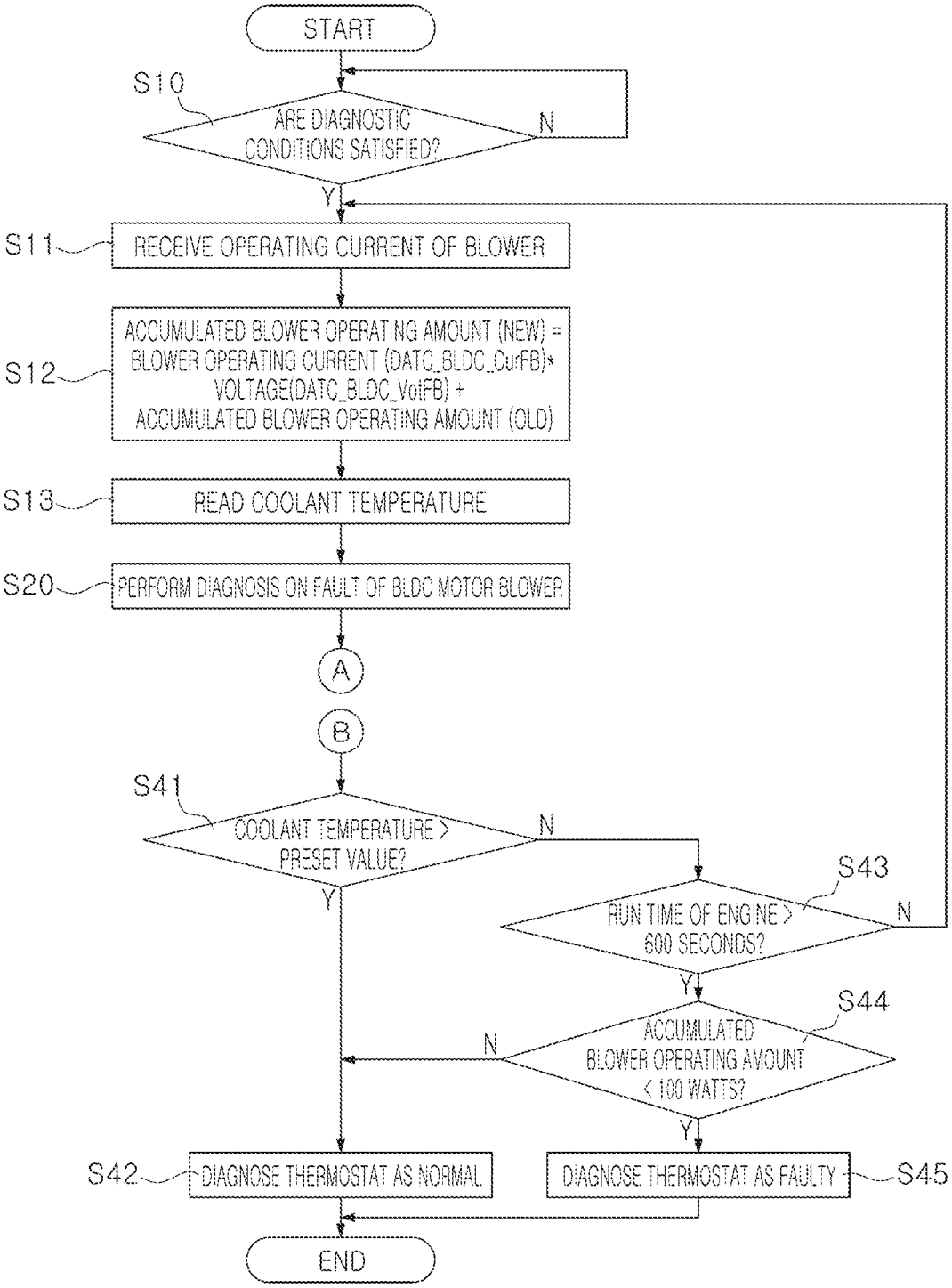
FIGS. 6 to 8 are diagrams sequentially illustrating the method of diagnosing a thermostat fault according to the present disclosure.
Figure 7:
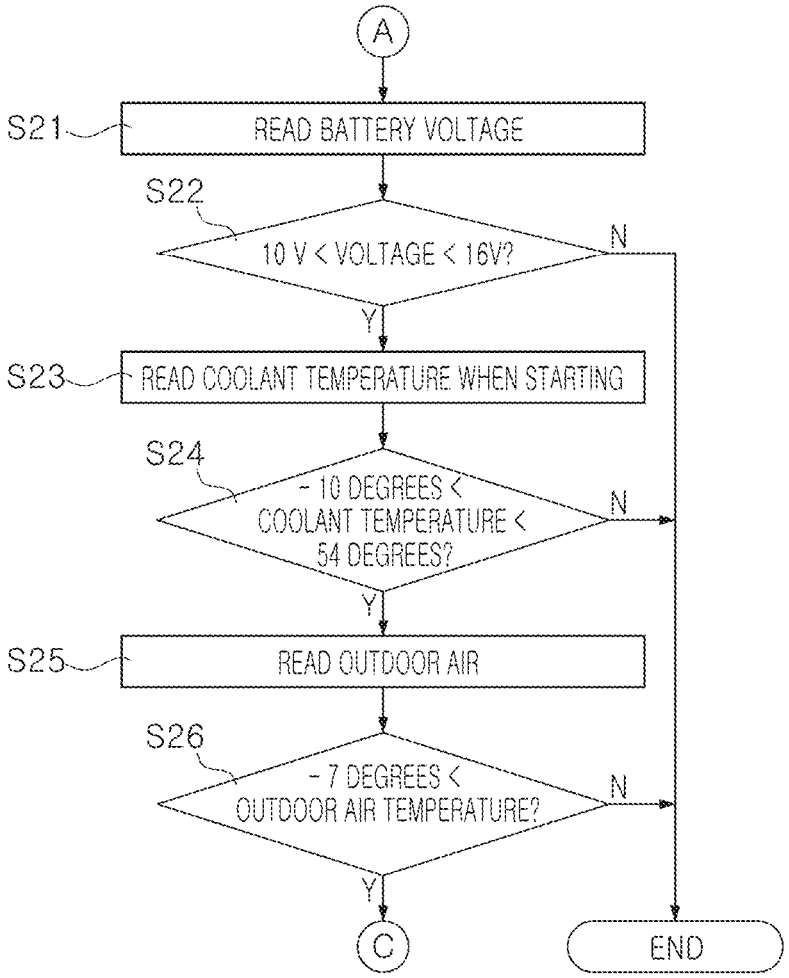
Figure 8:
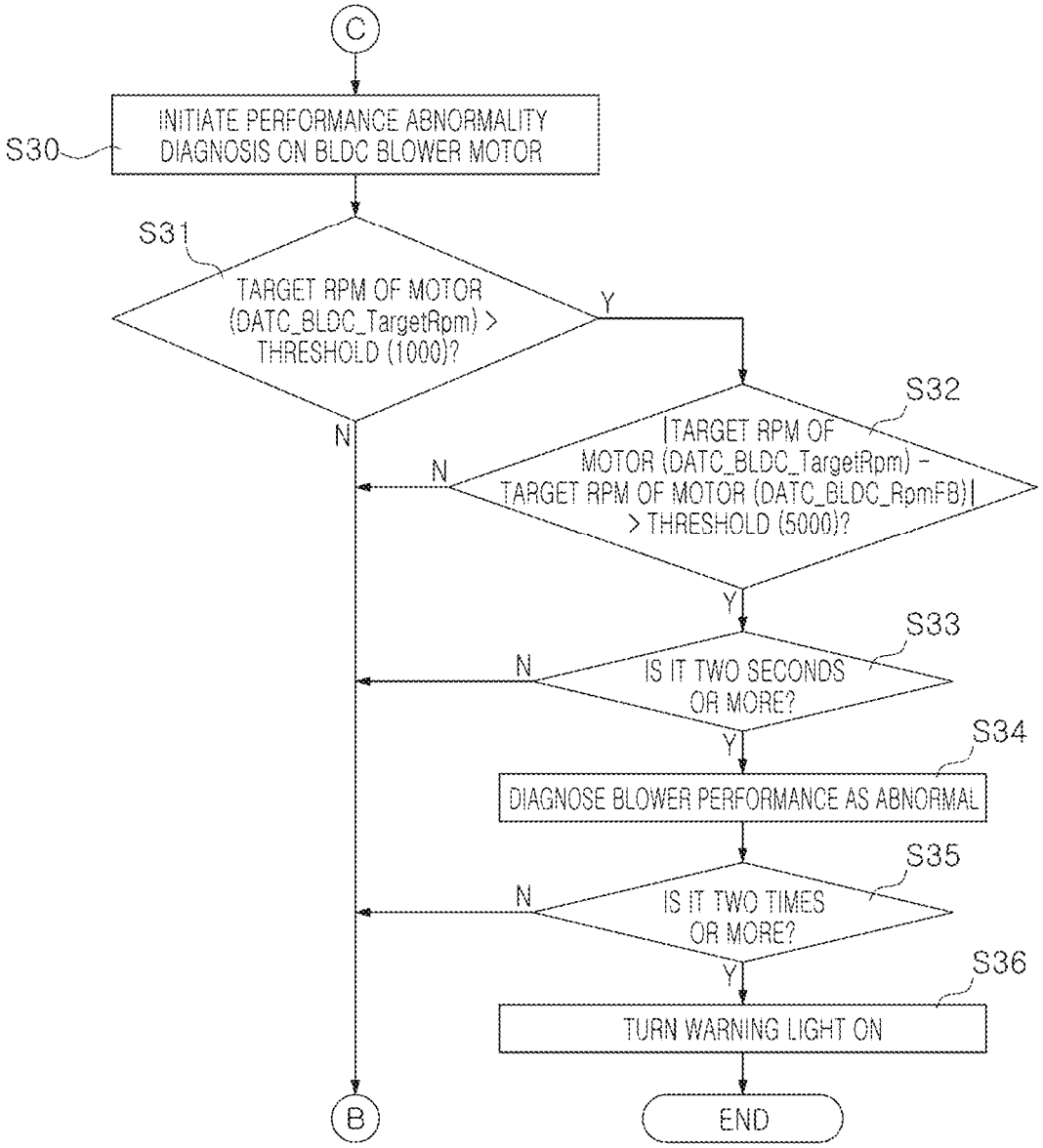

Hereinafter, an exemplary method of diagnosing a thermostat fault according to the present disclosure will be described with reference to FIGS. 6 to 8.

For example, the method can determine whether diagnostic conditions are satisfied (S10). The diagnostic conditions include, for example, determination of whether an outdoor air temperature exceeds −7° C. through an outdoor air temperature sensor and whether a coolant temperature is satisfied to be less than 54° C. when starting.

When the diagnostic conditions are satisfied, the ECU receives an operating current of the blower motor (S11) and uses the operating current to calculate an accumulated blower operating amount for a certain period of time (S12).

The accumulated blower operating amount, for example, an accumulated value for 600 seconds after the starting, can be calculated as follows:

$$\text{accumulated blower operating amount} = \int_0^{600} (\text{weighting factor } 1 \times \text{blower operating current} \times \text{blower operating voltage})\,dt$$

Then, a coolant temperature is received by the coolant temperature sensor (S13) and a fault diagnosis of the blower motor is performed (S14).

The fault diagnosis of the blower motor can be performed by receiving a battery voltage first (S21), determining whether the voltage exceeds, for example, 10 V and is less than 16 V (S22), and when the voltage is within a range, receiving the coolant temperature when the starting (S23), and when the voltage is out of the range, terminating the fault diagnosis.

Then, it can be determined whether the coolant temperature exceeds −10° C. and is less than −54° C. (S24), and when the coolant temperature is within a range, an outdoor air temperature is received (S25), and when the coolant temperature is out of the range, the procedure is terminated.

Then, it can be determined whether the outdoor air temperature exceeds −7° C. (S26), and when the outdoor air temperature exceeds −7° C., a more specific performance abnormality diagnosis of the blower motor is initiated (S30).

It can be determined whether a target rotation RPM of the blower motor exceeds a set value of a first RPM (e.g., 1000 RPM) (S31), and when the target rotation RPM exceeds the first RPM, the blower motor diagnosis can be continuously performed instead of the thermostat diagnosis.

That is, it is determined whether a deviation between the target RPM and a current RPM of the blower motor is greater than a set value of a second RPM (e.g., 5000 RPM) (S32). When the deviation is large, since a target temperature may not be reached as in the case of an open fault of the thermostat, the diagnosis of the thermostat is stopped, and the blower motor is diagnosed as having a performance abnormality.

In addition, it is determined whether the deviation in S32 is maintained for a certain period of time (two seconds) or more (S33), the blower performance is diagnosed as abnormal (S34), and whether the diagnosis is performed a certain number of times (two times) or more (S35), and a warning light is turned on (S36).

In some examples, when the target RPM of the blower motor is lower than or equal to the first RPM as the determination result in S31, diagnosis of whether a fault occurs in the thermostat is performed. This is because, when the target RPM of the blower motor is lower than or equal to the first RPM, it may be determined that an effect on a decrease of the coolant temperature due to the blower is small.

Thus, the coolant temperature is compared with a regulating temperature (S41).

The regulating water temperature is a temperature (thermostat opening temperature) controlled to prevent engine overheating and may be, for example, −11° C.

As the comparison result, when the coolant temperature exceeds the regulating temperature, the thermostat may be diagnosed as normal (S42).

In some examples, when the coolant temperature is lower than or equal to the regulating temperature, it can be determined whether a run time of the engine exceeds a certain period of time (600 seconds) (S43), and whether the run time of the engine exceeds the certain period of time, the accumulated blower operating amount calculated in S13 is compared with a set operating amount (S44).

As the comparison result, when the accumulated blower operating amount is less than the set operating amount, it may be diagnosed as a thermostat fault (S45), and the set operating amount may be, for example, 100 watts.

In some examples, when the accumulated blower operating amount is greater than or equal to the set operating amount, the thermostat is diagnosed as normal (S42).

In some examples, a model coolant temperature can be corrected by applying a compensation value considering an operating current and an operating voltage of the blower.

Therefore, the model coolant temperature can be expressed as follows:

Model coolant temperature=engine heating (combustion and block heater)−engine cooling (vehicle speed and outdoor air temperature)−engine cooling (blower operating current and voltage)

According to a method and a system for diagnosing a thermostat of an engine cooling system of the present disclosure, it is possible to diagnose a thermostat performance abnormality by considering an operation signal of a brushless direct current (BLDC) blower.

Therefore, it is possible to prevent or otherwise minimize a thermostat misdiagnosis which can occur due to not considering a blower operation.

It is also possible to diagnose a performance abnormality of the BLDC blower so that misdiagnosis can be prevented by only performing the thermostat diagnosis when the blower is operating normally.

While the present disclosure has been described with reference to the accompanying drawings, it will be apparent to those skilled in the art that various changes and modifications can be made without departing from the spirit and scope of the present disclosure without being limited to the exemplary implementations disclosed herein. Accordingly, it should be noted that such alternations or modifications fall within the claims of the present disclosure, and the scope of the present disclosure should be construed on the basis of the appended claims.

What is claimed is:

1. A method for diagnosing a thermostat of an engine cooling system, wherein the thermostat is disposed at an engine coolant path configured to circulate coolant through an engine and a heater core, the heater core being disposed at a rear of an evaporator that is disposed at a heating and cooling path, the method comprising:

receiving, from a heater control module by a diagnostic module, an operating current value of a blower motor configured to operate a blower, the blower being configured to supply outside air to the evaporator;

outputting, by the diagnostic module, a power amount applied to the blower motor for a first certain period of time based on the operating current value of the blower motor;

receiving, by the diagnostic module, a coolant temperature of the coolant;

performing, by the diagnostic module, a fault diagnosis of the blower motor;

outputting a faulty state signal of the thermostat based on the power amount being less than a set operating amount;

outputting a normal state signal of the thermostat based on the power amount being greater than or equal to the set operating amount;

terminating the fault diagnosis of the blower motor based on a target revolutions per minute (RPM) of the blower motor being less than or equal to a first RPM; and outputting the faulty state signal of the thermostat based on a deviation between the target RPM and a current RPM exceeding a second RPM for a second certain period of time, wherein terminating the fault diagnosis of the blower motor is performed based on the deviation between the target RPM and the current RPM of the blower motor being less than or equal to the second RPM for the second certain period of time.

2. The method of claim 1, wherein outputting the power amount comprises:

outputting the power amount by integrating a product of the operating current value and an operating voltage of the blower motor for the first certain period of time.

3. The method of claim 1, further comprising:

before performing the fault diagnosis of the blower motor, outputting the normal state signal of the thermostat based on the coolant temperature exceeding a set temperature, wherein outputting the faulty state signal of the thermostat is performed based on the coolant temperature being lower than or equal to the set temperature.

4. The method of claim 3, wherein the set temperature defines a thermostat opening temperature.

5. The method of claim 3, further comprising:

determining whether a run time of the engine exceeds the first certain period of time based on the coolant temperature being lower than or equal to the set temperature; and comparing the power amount to the set operating amount based on the run time of the engine exceeding the first certain period of time.

6. The method of claim 3, further comprising:

terminating the fault diagnosis of the blower motor based on the deviation between the target RPM and the current RPM of the blower motor being less than or equal to the second RPM while the target RPM exceeds the first RPM.

7. A system for diagnosing a thermostat of an engine cooling system, wherein the thermostat is disposed at an engine coolant path configured to circulate coolant through an engine and a heater core, the heater core being disposed at a rear of an evaporator that is disposed at a heating and cooling path, the system comprising:

a blower motor module configured to operate a blower motor, the blower motor being configured to operate a blower to supply outdoor air to the evaporator;

a heater control module configured to control the blower motor module and to receive an operating current value of the blower motor from the blower motor module; and a diagnostic module configured to:

receive the operating current value of the blower motor from the heater control module, output a power amount applied to the blower motor for a first certain period of time based on the operating current value of the blower motor, receive a coolant temperature of the coolant, perform a fault diagnosis of the blower motor, output a faulty state signal of the thermostat based on the power amount being less than a set operating amount, and output a normal state signal of the thermostat based on the power amount being greater than or equal to the set operating amount, wherein the diagnostic module is further configured to:

terminate the fault diagnosis of the blower motor and output the faulty state signal of the thermostat based on a target revolutions per minute (RPM) being lower than or equal to a first RPM, and continue the fault diagnosis of the blower motor based on the target RPM exceeding the first RPM.

8. The system of claim 7, wherein the diagnostic module is configured to output the power amount by integrating a product of the operating current value and an operating voltage of the blower motor for the first certain period of time.

9. The system of claim 7, wherein the diagnostic module is further configured to:

output the normal state signal of the thermostat based on the coolant temperature exceeding a set temperature, and wherein the diagnostic module is configured to output the faulty state signal of the thermostat based on the coolant temperature being lower than or equal to the set temperature.

10. The system of claim 9, wherein the set temperature defines a thermostat opening temperature.

11. The system of claim 9, wherein the diagnostic module is further configured to determine whether a run time of the engine exceeds the first certain period of time based on the coolant temperature being lower than or equal to the set temperature, and wherein the diagnostic module is configured to compare the power amount to the set operating amount based on the run time of the engine exceeding the first certain period of time.

12. The system of claim 9, wherein the diagnostic module is further configured to:

terminate the fault diagnosis of the blower motor based on a deviation between the target RPM and a current RPM being less than or equal to a second RPM while the target RPM exceeds the first RPM; and output the faulty state signal of the thermostat based on the deviation between the target RPM and the current RPM exceeding the second RPM for a second certain period of time.

13. The system of claim 12, wherein the diagnostic module is further configured to correct a model coolant temperature setting value based on the operating current value and an operating voltage of the blower motor, and wherein the blower motor module is configured to control the blower motor to operate based on the corrected model coolant temperature setting value.

* * * * *